US008701306B2

(12) United States Patent
Hardwick

(10) Patent No.: US 8,701,306 B2
(45) Date of Patent: Apr. 22, 2014

(54) HEAT DEFLECTOR FOR USE WITH A HOOD-TYPE HAIR DRYER

(76) Inventor: Rose Hardwick, Tulsa, OK (US)

( * ) Notice: Subject to any disclaimer, the term of this patent is extended or adjusted under 35 U.S.C. 154(b) by 1552 days.

(21) Appl. No.: 12/002,724

(22) Filed: Dec. 18, 2007

(65) Prior Publication Data

US 2008/0229607 A1 Sep. 25, 2008

Related U.S. Application Data

(63) Continuation-in-part of application No. 11/726,090, filed on Mar. 21, 2007, now abandoned.

(51) Int. Cl.
*A45D 20/12* (2006.01)

(52) U.S. Cl.
USPC ..... 34/97; 132/212; 392/384; D28/18; D29/108; 2/209

(58) Field of Classification Search
USPC ..... 34/95, 96, 97, 99, 100; 132/212; 392/384, 385; D28/18, 20; D29/102, D29/108; 2/174, 209
See application file for complete search history.

(56) References Cited

U.S. PATENT DOCUMENTS

| | | | | | |
|---|---|---|---|---|---|
| 2,031,001 | A | * | 2/1936 | Moss | 34/99 |
| 2,226,956 | A | * | 12/1940 | Womack | 2/174 |
| 2,298,170 | A | * | 10/1942 | Robinson | 34/90 |
| 2,327,678 | A | * | 8/1943 | Stovall | 2/174 |
| 2,446,053 | A | * | 7/1948 | Matarazzo | 2/195.4 |
| 3,032,891 | A | * | 5/1962 | Parker | 34/99 |
| 3,159,466 | A | * | 12/1964 | Nissman | 34/99 |
| 3,358,382 | A | * | 12/1967 | Georgia | 34/99 |
| 3,495,343 | A | * | 2/1970 | Duncanson | 34/72 |
| 4,547,903 | A | * | 10/1985 | Brown et al. | 2/12 |
| 4,662,084 | A | * | 5/1987 | Maass | 34/99 |
| 4,704,744 | A | * | 11/1987 | Myers | 2/174 |
| 4,934,068 | A | | 6/1990 | Curlee | |
| 5,091,995 | A | * | 3/1992 | Oates | 2/209 |
| 5,146,629 | A | * | 9/1992 | Barnes | 2/174 |
| 5,214,801 | A | * | 6/1993 | Christensen et al. | 2/174 |
| 5,218,772 | A | * | 6/1993 | Dickson, Sr. | 34/99 |
| 5,673,494 | A | | 10/1997 | Pham | |
| 5,675,840 | A | * | 10/1997 | Clavelle | 2/174 |
| 6,012,171 | A | * | 1/2000 | Altman | 2/174 |
| 6,029,364 | A | * | 2/2000 | Pickett | 34/99 |
| D422,115 | S | * | 3/2000 | Key | D28/18 |

(Continued)

OTHER PUBLICATIONS

International Search Report and Written Opinion; dated Jun. 25, 2008; issued by International Searching Authority ISA/US; 10 pages.

(Continued)

*Primary Examiner* — Steve M Gravini
(74) *Attorney, Agent, or Firm* — Gable Gotwals; Frank J. Catalano

(57) ABSTRACT

An air flow deflector for use with a hood-type hair dryer is a thick, resiliently compressible, unitary halo with an inner perimeter of length suited to surround and abut, preferably with tension, against the subject's head when the halo's inner perimeter is contoured approximately immediately below the subject's hair line. The halo deflects the flow of warm air away from exposed skin portions of the head, neck and shoulders. An arcuate upturned extension on its front portion deflects air flow back to the interior of the hood of the dryer. The unitary halo may be continuous or split for adjustability and hinged for increased manipulability.

14 Claims, 5 Drawing Sheets

(56) References Cited

U.S. PATENT DOCUMENTS

| | | | | |
|---|---|---|---|---|
| D424,239 | S * | 5/2000 | Key | D28/18 |
| D435,699 | S * | 12/2000 | Mowry | D29/102 |
| D437,452 | S * | 2/2001 | Sadovskaya | D28/20 |
| 6,233,745 | B1 * | 5/2001 | Friesen | 2/172 |
| D447,553 | S * | 9/2001 | Parker et al. | D23/386 |
| 6,647,553 | B2 * | 11/2003 | Hoyez | 2/209.12 |
| 2002/0138894 | A1 | 10/2002 | Brundidge | |
| 2008/0229607 | A1 * | 9/2008 | Hardwick | 34/99 |

OTHER PUBLICATIONS

International Preliminary Report on Patentability issued by the International Bureau of WIPO on Oct. 1, 2009 in corresponding PCT/US08/03578; 7 pages.

* cited by examiner

*Fig. 2*
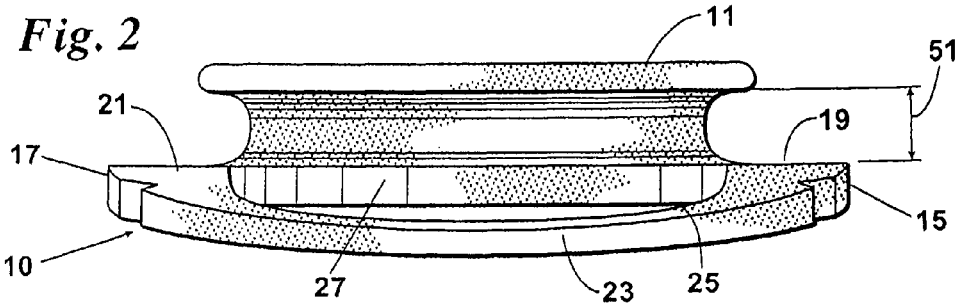
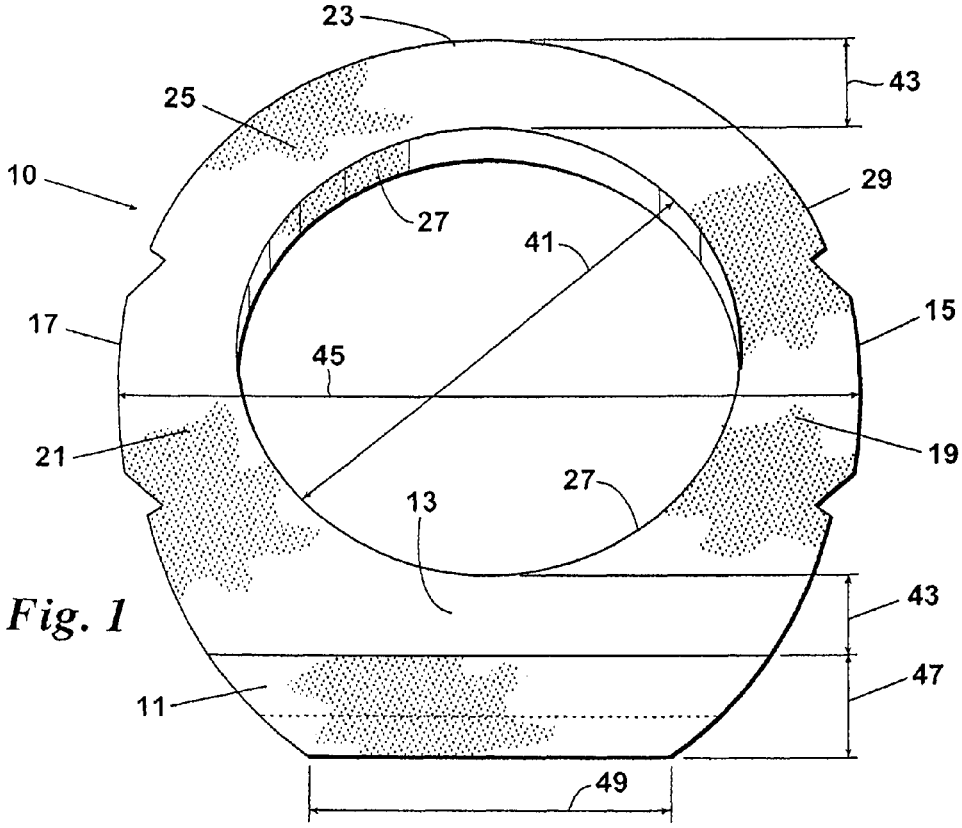
*Fig. 1*
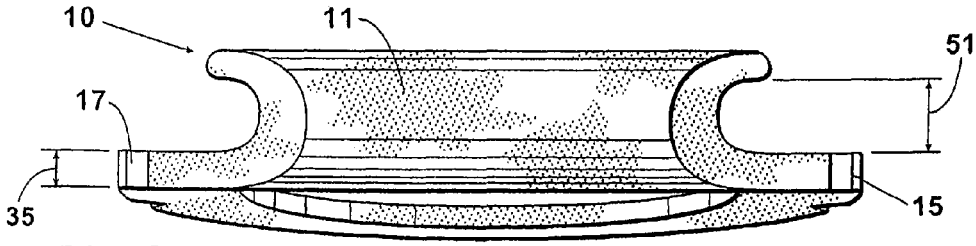
*Fig. 3*

HEAT DEFLECTOR FOR USE WITH A HOOD-TYPE HAIR DRYER

REFERENCE TO PENDING APPLICATIONS

This application is a continuation-in-part application claiming priority to U.S. patent application Ser. No. 11/726,090 filed Mar. 21, 2007, entitled Heat Deflector For Use With A Hood-Type Hair Dryer.

REFERENCE TO MICROFICHE APPENDIX

This application is not referenced in any microfiche appendix.

BACKGROUND OF THE INVENTION

This invention relates generally to hair dryer accessories and more particularly concerns a shield for redirecting the flow of warm air emanating from hood-type hair dryers commonly used in beauty parlors and salons.

Commonly used hood-type hair dryers cause a flow of warm air to pass radially over the scalp of the subject so that some of the warm air is irreversibly discharged from the dryer hood at its periphery. This loss of heat reduces the efficiency of operation of the dryer. Over and above this inefficiency, the discharged warm air is generally directed downwardly toward exposed-skin areas of the subject such as the face, shoulders, ears and neck. The direct and continuous application of heat to these areas is a source of discomfort and stress to the subject throughout the hair drying procedure.

Many attempts have been made to solve the latter problem. Shields have been devised in the shape of a truncated cone to be seated or held in place along its narrow diameter on the subject's head immediately below the hairline. The cone extends down to its widest diameter at the bottom so as to direct the flow of air in a downward direction but away from the subject's exposed skin areas. These conical shields are typically formed from flat sheets of paper or other relatively stiff material having an inner somewhat circular opening and an outer somewhat circular perimeter with a radial cut which permits overlapping of the paper to form a cone of size suited to the subject. One of a variety of mechanisms are incorporated into the shield for connecting the overlapped ends to prevent the sheet from returning to the flat condition during use. These shields must be assembled or adjusted before they are used. They are not readily, if at all, contourable to follow the hairline of the subject. They do not absorb or, if they do, are damaged by, accumulation of hairline moisture, though a separate moisture-absorbing piece of material has been attached to some of these shields. They are generally not washable or reusable. They do not facilitate recycling of discharged warm air back to the scalp and, therefore, do not have any positive effect on the efficiency of the dryer. While they may alleviate heat related discomfort to exposed skin areas to some degree, their relatively rigid construction results in gaps between portions of their inner openings and the hairline so that some of the discharged air is still directed at the areas intended to be protected. Furthermore, their structural rigidity causes discomfort at the contacted exposed skin areas of the subject.

It is, therefore, an object of this invention to provide, for use with a hood-type hair dryer, a heat deflector which tends to deflect the flow of discharged warm air away from the exposed-skin areas below the hairline of the subject. Another object of this invention is to provide, for use with a hood-type hair dryer, a heat deflector which tends to redirect the flow of discharged warm air back into the hood of the hair dryer. A further object of this invention is to provide, for use with a hood-type hair dryer, a heat deflector which enhances the efficiency of the hair dryer. Yet another object of this invention is to provide, for use with a hood-type hair dryer, a heat deflector which is conducive to the comfort of the subject during the operation of the dryer. It is also an object of this invention to provide, for use with a hood-type hair dryer, a heat deflector which is of unitary construction. Still another object of this invention is to provide, for use with a hood-type hair dryer, a heat deflector which requires no connecting components to secure the deflector in place below the hairline of the subject. An additional object of this invention is to provide, for use with a hood-type hair dryer, a heat deflector which is soft at all contact points with the subject. Another object of this invention is to provide, for use with a hood-type hair dryer, a heat deflector which requires no assembly or adjustments in preparation for being worn by the subject. A further object of this invention is to provide, for use with a hood-type hair dryer, a heat deflector which is capable of contouring to the head of the subject. Yet another object of this invention is to provide, for use with a hood-type hair dryer, a heat deflector which can absorb moisture which may accumulate at the subject's hairline during the operation of the dryer. It is also an object of this invention is to provide, for use with a hood-type hair dryer, a heat deflector which is washable. Still another object of this invention is to provide, for use with a hood-type hair dryer, a heat deflector which is reusable. And it is an object of this invention to provide, for use with a hood-type hair dryer, a heat deflector which can reasonably be so modestly priced as to be treated as a throw-away device.

SUMMARY OF THE INVENTION

In accordance with the invention, an air flow deflector for use with a hood-type hair dryer is provided. The deflector is a thick, resiliently compressible, unitary halo with an inner perimeter of length suited to surround and abut, preferably with tension, against the subject's head when the halo's inner perimeter is contoured approximately immediately below the subject's hair line to deflect the flow of warm air away from exposed skin portions of the head, neck and shoulders. The outer perimeter of the halo is sized to fit within the inner perimeter of the hood-type hair dryer in which the subject's head is to be oriented. In the preferred embodiment, the halo has an arcuate upturned extension on its front portion and within the inner perimeter of the hood-type hair dryer for deflecting air flow back to the interior of the hood of the dryer. The extension of the preferred embodiment will have an approximately 90° arc or greater and most preferably an approximately 180° arc. The halo may also have wings extending outwardly from its side portions, the orientation, width and length of each wing being sufficient to extend laterally above and span forwardly to rearwardly across a corresponding ear of the subject. The halo may also extend arcuately downwardly over approximately its rear half to its trailing extremity to facilitate contouring to the rear portion of the hairline which extends over the ears and toward the nape of the neck. This may also be facilitated if the halo is sufficiently flexible to more readily follow approximately immediately below a contour of the subject's hairline. Preferably, the halo is also sized to be released from tension when the halo surrounds the subject's neck and rests on the subject's shoulders.

In use, the halo is slid downwardly against tension over the top of the head of the subject to a position at least below the hairline of the subject. The subject's hair is then set, with or without use of rollers. After setting, the halo is slid upwardly against tension to approximately the hairline of the subject and then the inner perimeter of the halo is contoured to approximately immediately below the contour of the subject's hairline. The subject's head with the halo with the halo in proper place can then be positioned within the inner perimeter of the dryer hood. After the dryer has been operated to dry the subject's hair, the subject may exiting the hair dryer. If no rollers have been used, the halo is slid upwardly over the top of the subject's head to remove it. If setting comprising applying rollers are used in setting the hair, the halo is slid downwardly from the subject's hairline and the rollers removed from the hair before the halo is slid upwardly over the top of the subject's head. When sliding the halo below the hairline, it is especially convenient to rest the halo around the neck and on the shoulders of the subject.

In a second embodiment, the unitary halo may be a split ring with overlapping end portions. The end portions are adapted to facilitate adjustment of the circumferential length of the halo to permit surrounding abutment of the subjects head by the halo. The adjustment may be achieved by use of lengths of mating segments of hook and loop material, one fixed on a bottom face of one end portion and another fixed on a top face of the other end portion.

In a third embodiment, the unitary halo is adapted to facilitate hinge-like flexing of the halo approximately on an axis dividing the halo into forward and rearward portions. This may be accomplished by inclusion in the halo of sinusoid-like cross-sectional segments which straddle the dividing axis. For example, each sinusoid-like cross-sectional segment may have two crests and a nadir. In this embodiment, if the halo incorporates the arcuate upturned extension on its front portion and the wings which extend outwardly from its side portions for covering corresponding ears of the subject, the axis of flexing will be located between the extension and the wings.

The deflector may incorporate various combinations of one or more features described in relation to the three embodiments, including the continuous or split ring, the non-hinged or hinged sections and/or the flat or arcuate front extension.

In using a deflector with the split-ring halo, the halo is first positioned loosely around approximately the hairline perimeter of the subject's head. One end portion of the split ring halo is adjusted to overlap the other to draw the inner perimeter of the halo into abutment with the head of the subject. The end portions of the split ring halo are then secured to each other in the adjusted overlap condition. With the overlap secured, the halo is contoured to approximately immediately below the contour of the subject's hairline. If the halo has the arcuate upturned extension on its front portion, when the halo is positioned on the subject's head, the extension is oriented in front of the forehead of the subject. If the halo has hinge-like flexing sections, the flexing sections are approximately aligned with the subject's temples.

BRIEF DESCRIPTION OF THE DRAWINGS

Other objects and advantages of the invention will become apparent upon reading the following detailed description and upon reference to the drawings in which:

FIG. 1 is a top plan view of the air flow deflector;

FIG. 2 is a rear elevational view of the air flow deflector;

FIG. 3 is a front elevational view of the air flow deflector;

Figure 5:
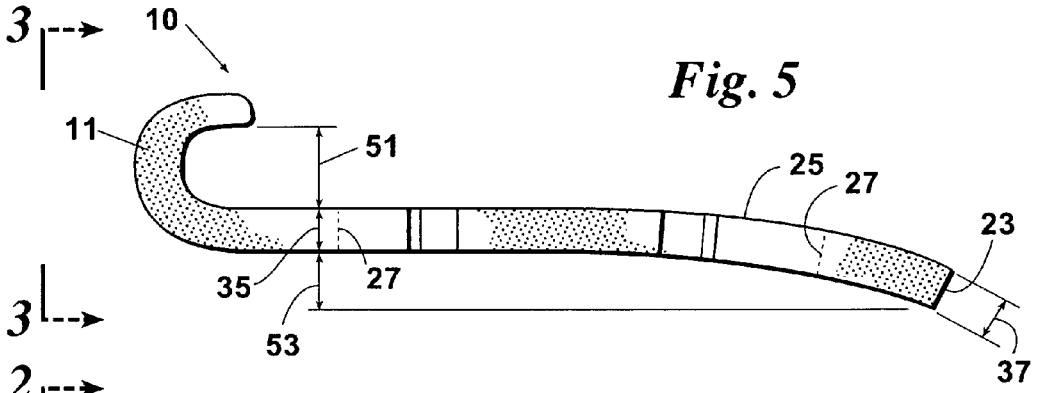
FIG. 5 is a left side elevational view of the air flow deflector.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Turning to FIGS. 1-7, a preferred embodiment of an air flow deflector for use with a hood-type hair dryer D is illustrated. The deflector consists of a thick, resiliently compressible, unitary halo 10 which can be contoured to a subject's hairline L. The halo 10 deflects the flow of warm air away from exposed skin portions of the head H, neck N and shoulders S of the subject. In the preferred embodiment shown, the halo 10 has an arcuate upturned extension 11 on its front portion 13 which not only deflects air away from the subject's exposed skin but also deflects air flow back into the interior of the hood of the dryer D. To further protect the subject's ears E, the halo 10 may also have wings 15 and 17 extending outwardly from its side portions 19 and 21 respectively. To facilitate contouring to the rear portion of the hairline L, which extends over the ears E and drops toward the nape of the neck N, the halo 10 may be extended arcuately downwardly over approximately its rear half to its trailing extremity 23, may be made of material sufficiently flexible to more readily follow the contour, may have a rear portion 25 tapered to increase its flexibility or may use any combination of these characteristics.

Figure 4:
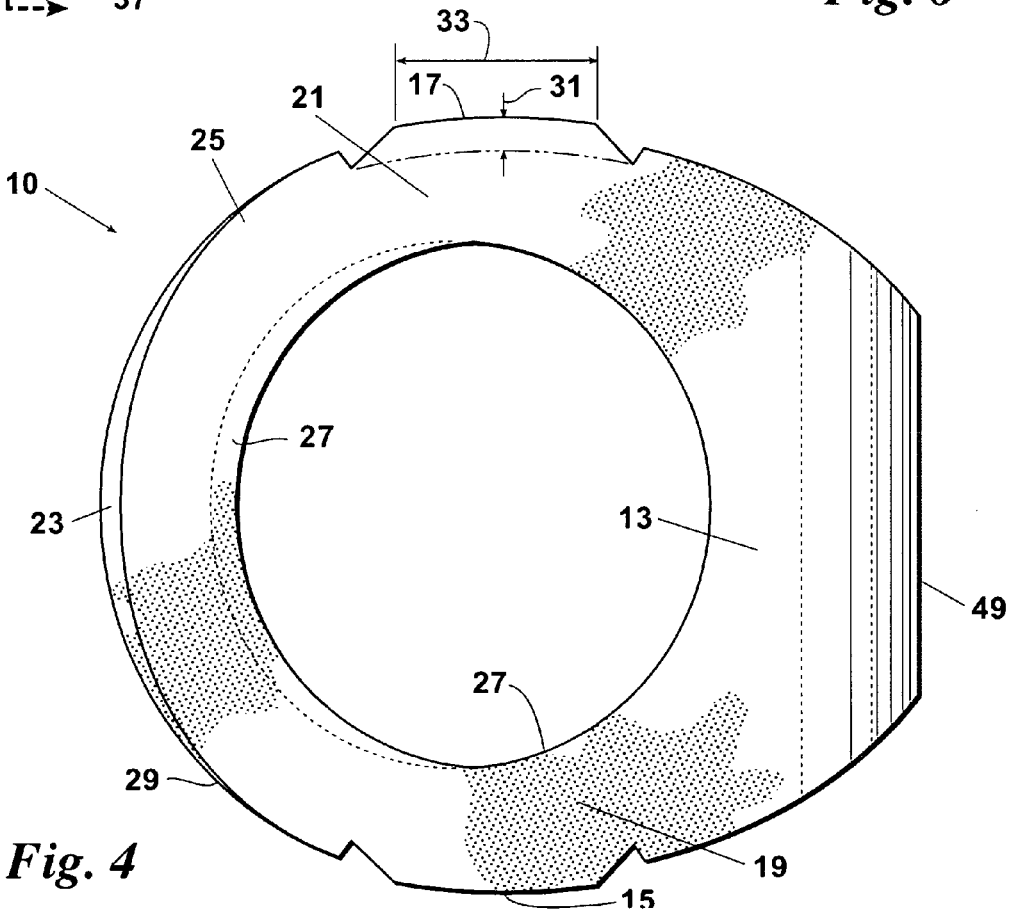
FIG. 4 is a bottom plan view of the air flow deflector.
Figure 7:
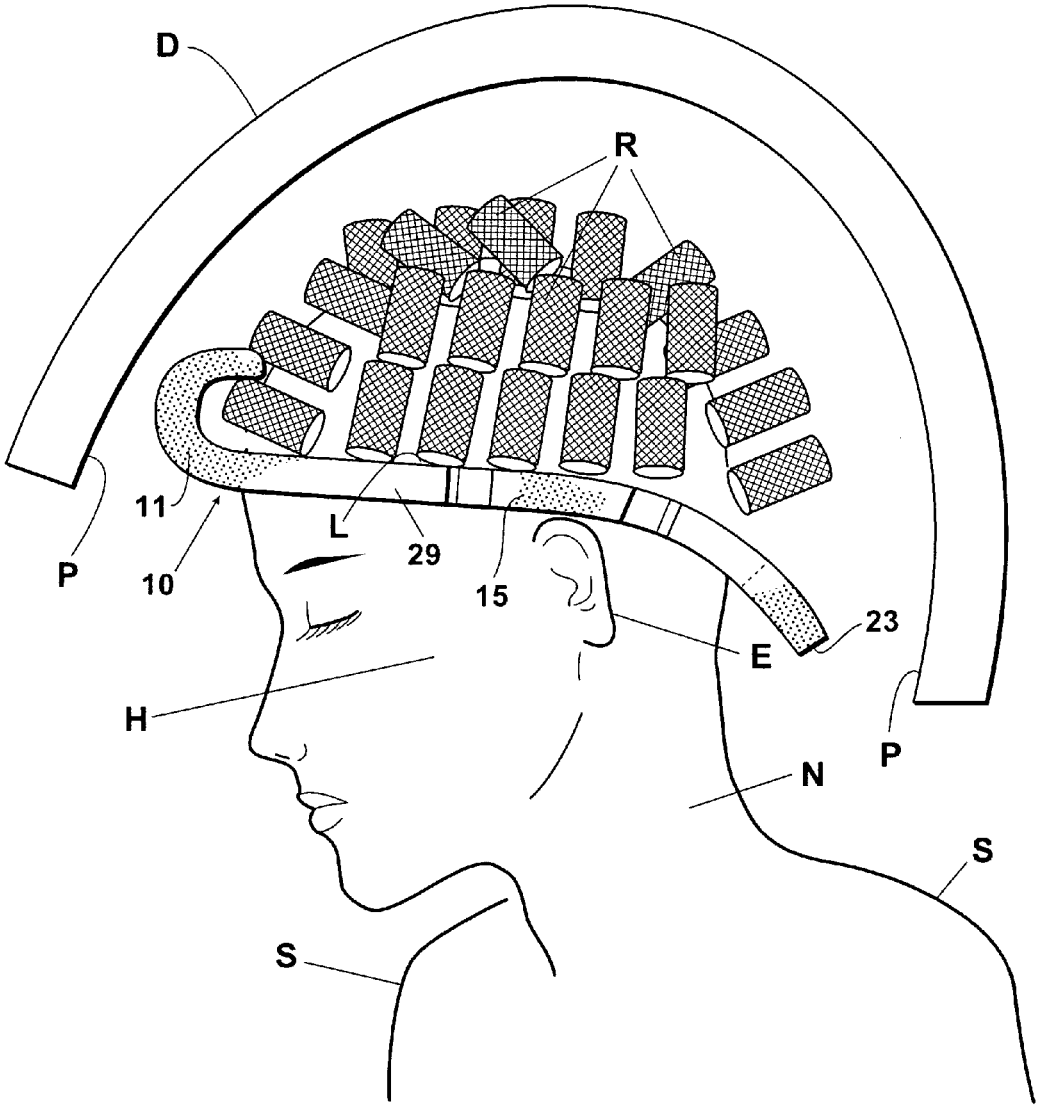
FIG. 7 is a perspective view of the air flow deflector in place below the hairline of a subject and disposed in the hood of a hair dryer.

Looking at FIGS. 1 and 4, the halo 10 has an inner perimeter 27 of length suited to surround and abut, preferably with tension, against the subject's head H when the halo's inner perimeter 27 is contoured approximately immediately below the subject's hair line L, as is best seen in FIG. 7. As is also seen in FIG. 7, the outer perimeter 29 of the halo 10 is sized to fit within the inner perimeter P of the hood-type hair dryer D. Preferably, the inner perimeter of the halo 10 is also sized to be released from tension when the halo 10 is lowered sufficiently to surround the subject's neck N and rest on the subject's shoulders S.

Figure 6:
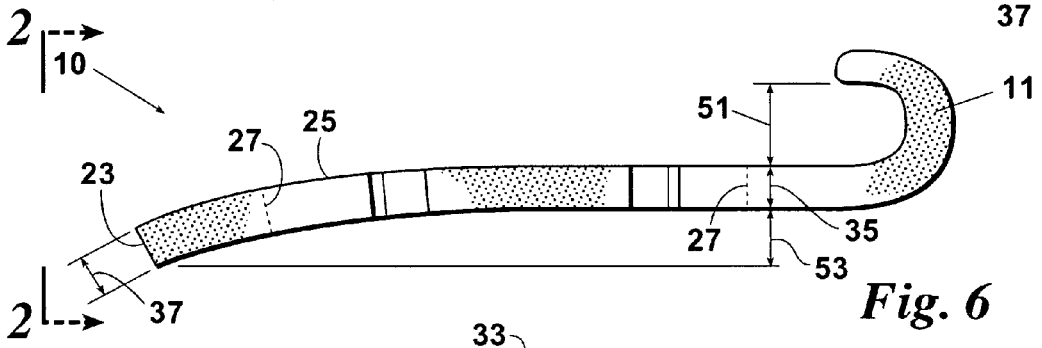
FIG. 6 is a right side elevational view of the air flow deflector.

In FIGS. 5 and 6, the upwardly curved extension 11 of the preferred embodiment is seen to have an approximately 180° arc. An approximately 90° arc or greater would also improve the efficiency of the dryer D, though perhaps to a lesser extent. The entire halo 10, including the extension 11, should be sized to fit within the hood of the dryer D.

As seen in FIGS. 4-7, the wings 15 and 17 are oriented on the halo 10 so that each wing 15 and 17 is positioned above a corresponding ear E when the halo 10 is in its proper position on the subject's head H. The width 31 of each wing 15 and 17 is sufficient to extend laterally at least above its corresponding ear E. The length 33 of each wing 15 and 17 is sufficient to span forwardly to rearwardly at least across its corresponding ear E.

The halo 10 is preferably made from a sponge-like material with sufficient body to prevent undue sagging and drooping while being comfortable on the skin. It is preferably resiliently compressible and deformable, washable and moisture absorbing. It is also preferably inexpensive enough to be a single use, throw-away. An aerated foam, specifically a polyester anti-static foam, was used to make a satisfactorily functional prototype. The prototype was made from a ⅝" thickness 35 of the polyester anti-static foam which tapered to a thickness 37 of ⅜" at its rear extremity 23. The prototype had an inner diameter 41 of approximately 6" and a halo width 43 of about 1-¼". The distance 45 across the wings was approximately 9" and the upwardly curved extension 11 added a forward distance 47 of approximately 1-¾" to the halo 10 and had a forwardmost width 49 of approximately 5". The inner diameter 51 of the curved extension 11 was approximately 1-¼" and the downturn 53 of the rear half of the halo 10 was approximately 1-¼" at the rear most extremity 23. These dimensions represent one, but not the only, workable proportionality of the dimensions of the halo 10. The references to diameter above made are not intended to infer that the corresponding components are perfect circles. Rather, the referenced dimensions may be somewhat oblong.

As will be appreciated in reference to FIG. 7, in use, after any initial preparation of the subject's hair, such as washing and combing, the halo 10 is slid downwardly against tension over the top of the head H of the subject to a position at least below the hairline L of the subject. To accomplish this, the halo's inner perimeter 27 is positioned around the top of the head H and the halo 10 is pulled down over the head H preferably until rested on the shoulders S around the neck N. Preferably, the front of the halo 10 is oriented to the front of the neck N with the wings 15 and 17 aligned with the ears E. The subject's hair is then set, with or without use of rollers R. After setting, the halo 10 is slid upwardly against tension to approximately the hairline L of the subject. This is accomplished by pulling the halo 10 up toward the hairline L and around the ears E. The inner perimeter 27 of the halo is then contoured to approximately immediately below the contour of the subject's hairline L. After the halo 10 is comfortably positioned, the subject's head H with the halo 10 in proper place can be positioned within the inner perimeter 27 of the hood of the dryer D. After the dryer D has been operated to dry the subject's hair, the subject may exit the hair dryer D. If no rollers R have been used, the halo 10 is slid upwardly over the top of the subject's head H. If rollers R are used in setting the hair, the halo 10 is slid downwardly from the subject's hairline L and the rollers R removed from the hair before the halo 10 is slid upwardly over the top of the subject's head H. In either event, the hair can then be styled with the halo 10 removed. Whenever the halo 10 is slid below the hairline L, it is especially convenient to rest the halo 10 around the neck N and on the shoulders S of the subject.

The halo 10 thus deflects air flow away from the exposed skin of the subject and also, in the preferred embodiment, recaptures warm air by redirecting it into the hood of the dryer D, increasing efficiency and decreasing the subject's time under the dryer D. It has also been found to be useful during the cutting of shorter hair to catch clippings that might otherwise fall on the neck N and shoulders S.

Figure 8:
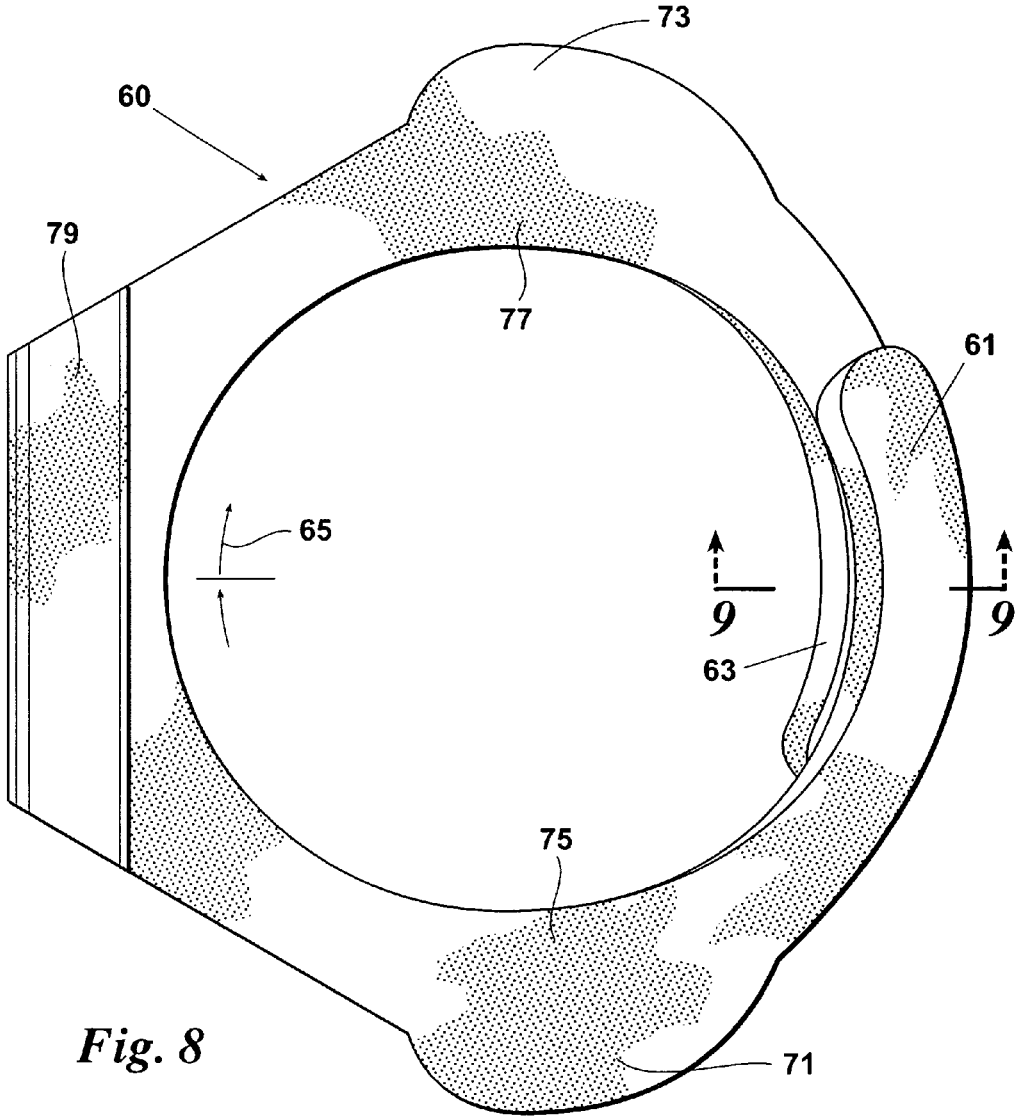
FIG. 8 is a top plan view of the air flow deflector with a split ring halo.
Figure 9:
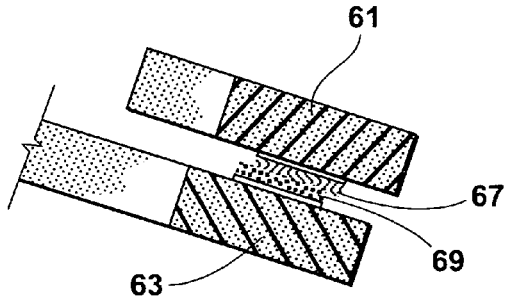
FIG. 9 is a cross-sectional view taken along the line 9-9 of FIG. 8.

Turning to FIGS. 8 and 9, a split ring embodiment of the unitary halo 60 has overlapping end portions 61 and 63. The end portions 61 and 63 are adapted to facilitate adjustment of the inside circumferential length 65 of the halo 60 to permit surrounding abutment of the subject's head by the halo 60. The adjustment may be achieved by use of lengths of mating segments of hook and loop material 67 and 69. One segment 67 is fixed on a bottom face of one end portion 61. The other segment 69 fixed on a top face of the other end portion 63. For example, in a prototype split ring deflector, the overlapping end portions 61 and 63 allow adjustment from a smallest inner perimeter of the halo of 18½" to a largest inner perimeter of the halo of 23½" with two mating 2½" segments 67 and 69. As shown, the split ring halo 60 has wings 71 and 73 extending outwardly from its side portions 75 and 77, respectively and an upwardly curved forward extension 79.

Figure 10:
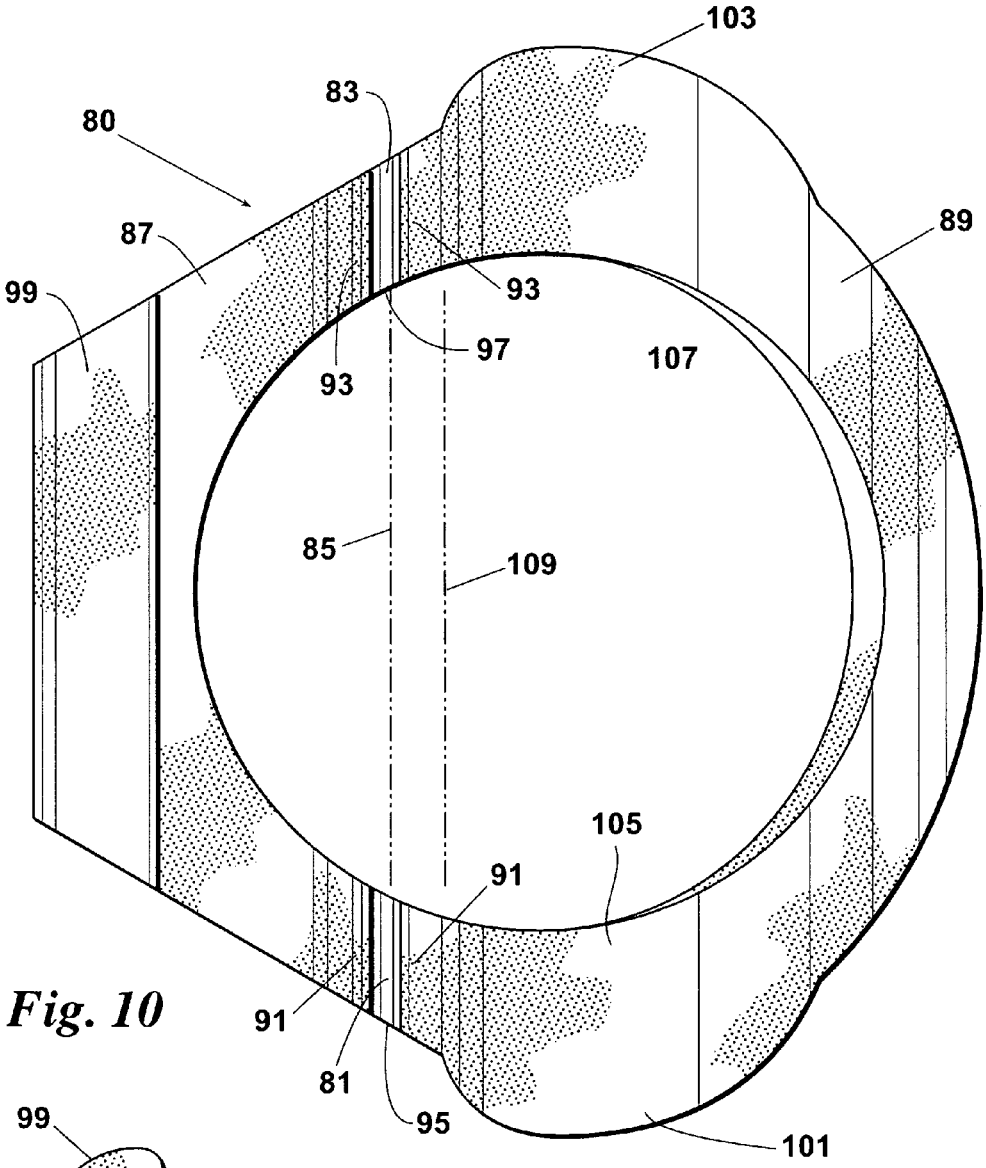
FIG. 10 is a top plan view of the air flow deflector with hinge-like flexing sections.
Figure 11:
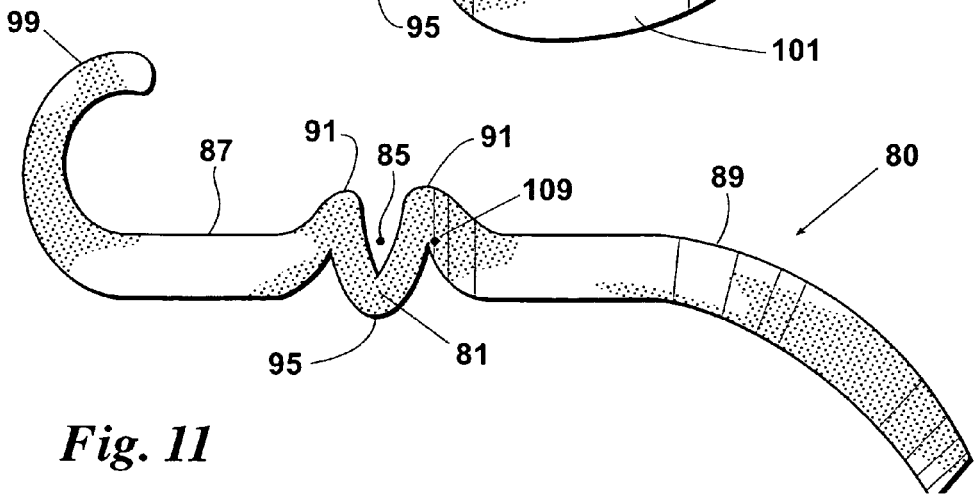
FIG. 11 is a side elevation view of the halo of FIG. 10.

Looking at FIGS. 10 and 11, a more easily manipulable embodiment of the unitary halo 80 has hinge-like flexing sections 81 and 83 aligned approximately on an axis 85 dividing the halo 80 into forward and rearward portions 87 and 89. As shown, this is accomplished by inclusion in the halo 80 of sinusoid-like cross-sectional segments 81 and 83 which straddle the dividing axis 85. Each sinusoid-like cross-sectional segment 81 or 83, as shown, has two crests 91 or 93 and a nadir 95 or 97. If, as shown, the hinge-like flexing halo 80 incorporates the arcuate upturned extension 99 on its front portion and the wings 101 and 103 which extend outwardly from its side portions 105 and 107, respectively, for covering corresponding ears of the subject, the axis of flexing 85 will be located between the extension 99 and a parallel axis 109 proximate the forward ends of the wings 101 and 103.

The deflector may incorporate various combinations of one or more features described in relation to the three embodiments including the arcuate front extension 10, the split ring 60 and/or the hinged sections 80.

In using a deflector with the split-ring halo 60, the halo 60 is first positioned loosely around approximately the hairline perimeter of the subject's head. One end portion 61 of the split ring halo 60 is adjusted to overlap the other 63 to draw the inner perimeter 65 of the halo 60 into abutment with the head of the subject. The end portions 61 and 63 of the split ring halo 60 are then secured to each other in the adjusted overlap condition. With the overlap secured, the halo 60 is contoured to approximately immediately below the contour of the subject's hairline. If the halo 60 has the arcuate upturned extension 79 on its front portion, when the halo 60 is positioned on the subject's head, the extension 79 is oriented in front of the forehead of the subject. If, as in the halo 80, the hinge-like flexing sections 81 and 83 are incorporated, the flexing sections 81 and 83 are approximately aligned with the subject's temples.

Thus, it is apparent that there has been provided, in accordance with the invention, an air flow deflector for use with hood-type hair dryers that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modification and variations as fall within the spirit of the appended claims.

What is claimed is:

1. For positioning on a subject's head, an air flow deflector comprising a thick, resiliently compressible, unitary halo having an inner perimeter of length suited for surrounding abutment against the subject's head with said inner perimeter contoured approximately immediately below a hair line of the subject, said unitary halo having a split ring with overlapping end portions and means on said end portions for adjusting a circumferential length of said halo to said surrounding abutment.

2. A deflector according to claim 1, said adjusting means comprising lengths of mating segments of hook and loop material, one said segment being fixed on a bottom face of one said end portion and another said segment being fixed on a top face of another said end portion.

3. A deflector according to claim 1, said unitary halo having means for facilitating hinge-like flexing of said halo approximately on an axis dividing said halo into forward and rearward portions.

4. A deflector according to claim 3, said facilitating means comprising sinusoid-like cross-sectional segments straddling said axis.

5. A deflector according to claim 4, said sinusoid-like cross-sectional segments having two crests and a nadir.

6. A deflector according to claim 3, said halo having an arcuate upturned extension on a front portion thereof and wings extending outwardly from side portions thereof for covering corresponding ears of the subject, said axis of flexing being between said extension and said wings.

7. For positioning on a subject's head, an air flow deflector comprising a thick, resiliently compressible, unitary halo having an inner perimeter of length suited for surrounding abutment against the subject's head with said inner perimeter contoured approximately immediately below a hair line of the subject, said unitary halo having means for facilitating hinge-like flexing of said halo approximately on an axis dividing said halo into forward and rearward portions.

8. A deflector according to claim 7, said facilitating means comprising sinusoid-like cross-sectional segments straddling said axis.

9. A deflector according to claim 8, said sinusoid-like cross-sectional segments having two crests and a nadir.

10. A deflector according to claim 7, said halo having an arcuate upturned extension in a front portion thereof and wings extending outwardly from side portions thereof for covering corresponding ears of the subject, said axis of flexing being between said extension and said wings.

11. For improving the efficiency of a hood-type hair dryer by use of a resiliently compressible unitary split ring halo of adjustable length, a method comprising the steps of:

positioning the split ring halo loosely around approximately the hairline perimeter of a subject's head;

adjusting an end portion of the split ring halo to draw an inner perimeter of the halo into abutment with the head of the subject;

securing the end portions of the split ring halo to each other in the adjusted overlap condition; and contouring the halo to approximately immediately below the contour of the subject's hairline.

12. A method according to claim 11, said halo having an arcuate upturned extension on a front portion thereof and said step of positioning further comprising positioning the extension in front of the subject's forehead.

13. A deflector according to claim 1, said halo being contourable to permit said inner perimeter to trace a pattern approximately immediately below a hair line of the subject.

14. A deflector according to claim 1, said unitary halo having an outer perimeter sized to fit within an inner perimeter of a hair dryer with which said halo is used.

* * * * *